US005221004A

United States Patent [19]

Murphy

[11] Patent Number: 5,221,004

[45] Date of Patent: Jun. 22, 1993

[54] REED HOLDER

[76] Inventor: Timothy M. Murphy, 109 Harmony Hall Rd., Gaithersburg, Md. 20877

[21] Appl. No.: 696,770

[22] Filed: May 7, 1991

[51] Int. Cl.[5] ..... A45C 11/00; B65D 73/00

[52] U.S. Cl. ..... 206/314; 206/805; 206/495; 206/479

[58] Field of Search ..... 206/314, 805, 495, 479, 206/477, 806, 825, 214, 224, 371, 443, 583

[56] References Cited

U.S. PATENT DOCUMENTS

| | | | |
|---|---|---|---|
| 539,682 | 5/1895 | Greves | 206/214 |
| 893,608 | 7/1908 | Danne | 206/214 |
| 1,745,590 | 2/1930 | Stanger | 190/100 |
| 1,997,820 | 4/1935 | Govoni | 206/314 |
| 2,316,328 | 4/1943 | Guenther et al. | 190/108 |
| 3,203,298 | 8/1965 | Sumrall | 206/314 |
| 3,314,194 | 4/1967 | Halleck | 206/813 |
| 4,089,412 | 5/1978 | Baugh | 206/314 |
| 4,250,995 | 2/1981 | Lorenzini | 206/314 |
| 4,352,428 | 10/1982 | Pascucci et al. | 206/314 |
| 4,674,630 | 6/1987 | Kirck | 206/314 |

*Primary Examiner*—Steven N. Meyers
*Assistant Examiner*—M. D. Patterson
*Attorney, Agent, or Firm*—Joseph J. Zito

[57] ABSTRACT

A case for holding, storage, protection and working of cane reeds for woodwind instruments which secures a number of reeds to protect against damage and distortion. The reed case maintains reeds in a flat condition during storage, insulates them from impact during storage, acts as a working surface in the restoration of desired reed qualities, and provides a container with a controlled environment for reed storage. The individual reeds are secured flat against interior surfaces of a central core member. The surfaces can be provided with ventilation holes for homogeneous reed drying. The reeds are protected from contact or damage by the core member. An outer cover can be added to further protect the reeds and to provide a controlled environment for storage. The holder taught in the present invention also provides a second set of flat surfaces, on the exterior of the core member opposite the reed securing surfaces, for use as working surfaces in the adjustment of reeds.

20 Claims, 2 Drawing Sheets

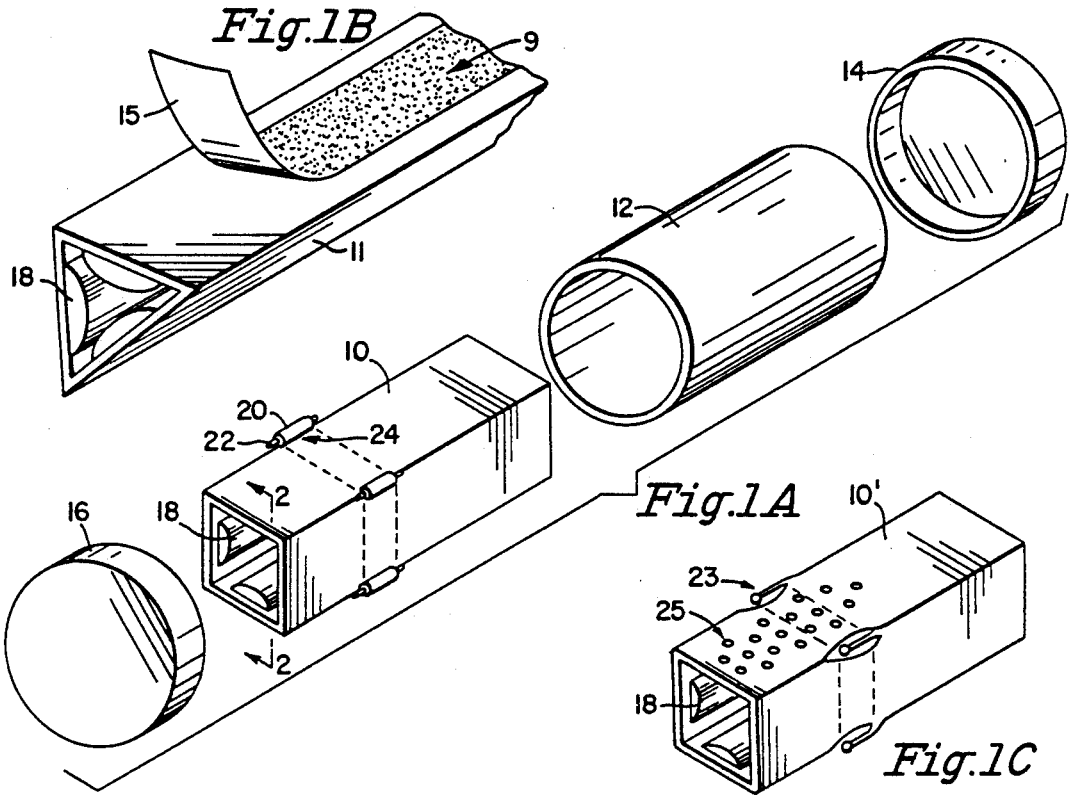
Fig.1B
9
15
14
12
11
18
10
20
22
24
2
16
18
2
Fig.1A
10'
23
25
18
Fig.1C
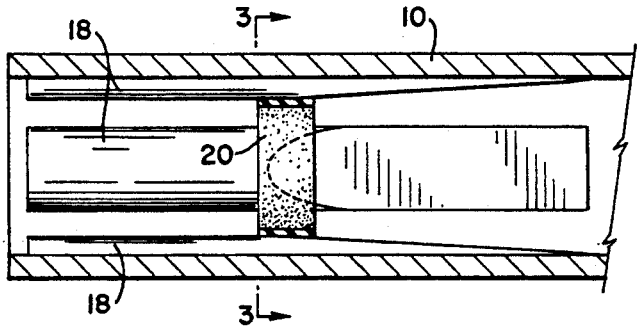
Fig.2
18
3
10
20
18
3
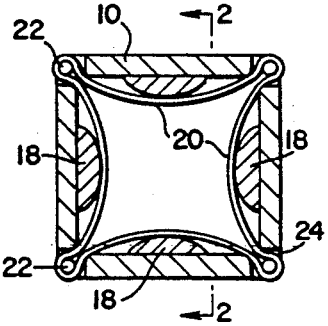
Fig.3
22
10
2
20
18
18
24
22
18
2

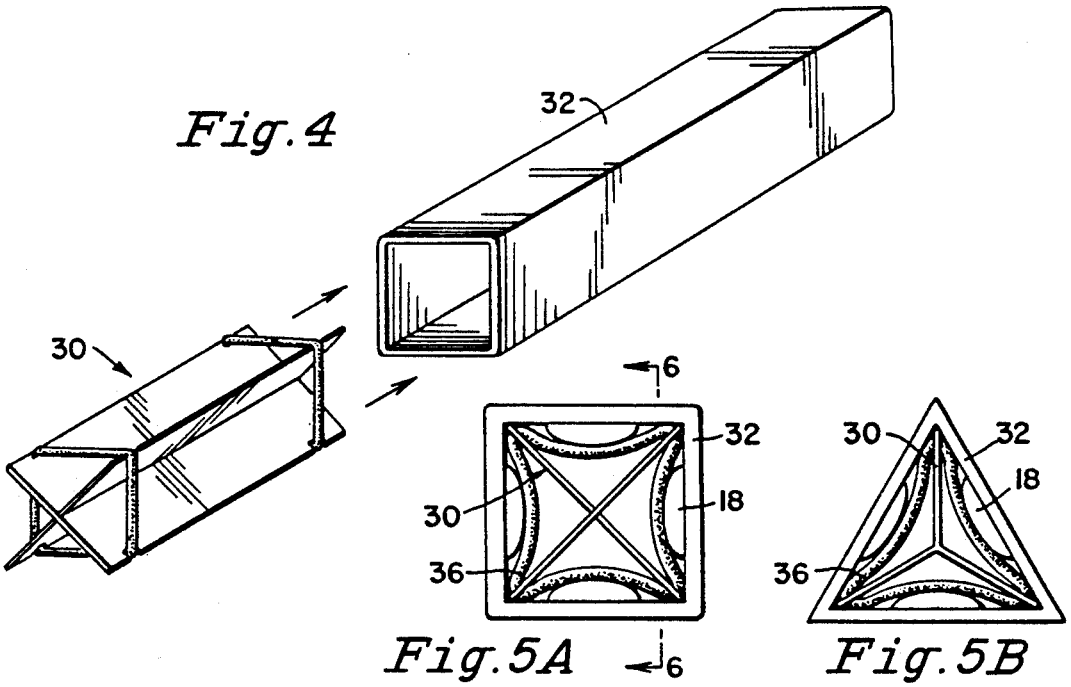
Fig.4
Fig.5A
Fig.5B
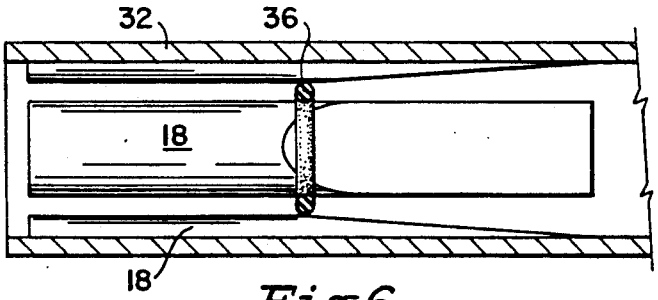
Fig.6
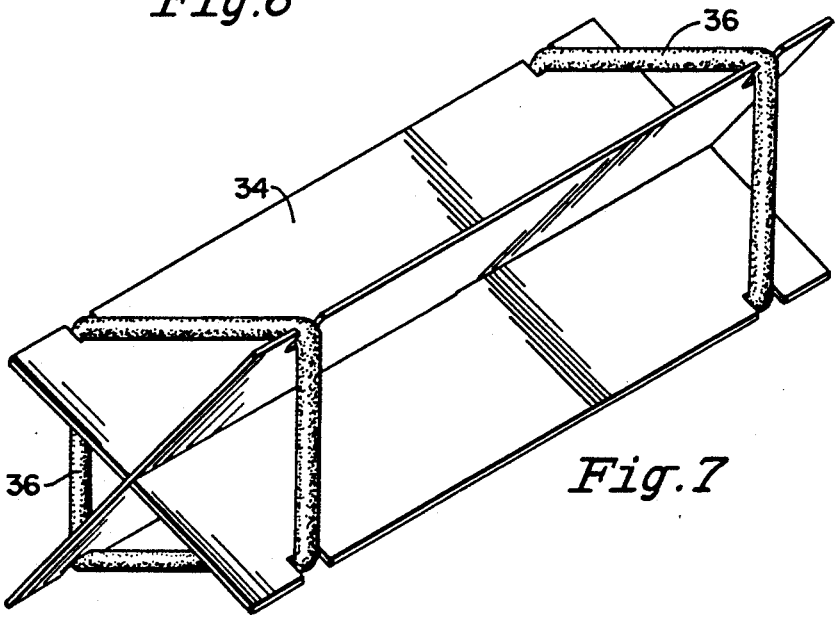
Fig.7

REED HOLDER

BACKGROUND OF THE INVENTION

The present invention relates to cases for holding, storage and protection of cane reeds for woodwind instruments. More specifically, the present invention relates to protective cases which secure a number of reeds to reduce damage and distortion.

As well known in the art, reeds can become distorted because of the stresses they are subjected to during playing and storage. The reeds become saturated during play and dry during storage. This moisture change is known to cause distortion of reeds. It is also known that maintaining a flat shape for the reed during drying can substantially reduce the reed distortion. Holding a reed against a flat surface while the reed is not in use can effect a desired degree of distortion prevention.

Reed cases which hold a number of reeds against a flat surface have been known at least as early as 1906, as taught in U.S. Pat. No. 828,145 to Snodgrass. Reed holders have assumed a number of shapes, such as the flat construction taught in Pascucci U.S. Pat. No. 4,352,428 and Kirck U.S. Pat. No. 4,674,630, where the reeds are held against opposite sides of a central planar member. The Vandoren reed case is also similar in construction to both Pascucci and Kirck and provides a tight enclosure for reed storage.

Lorenzini U.S. Pat. No. 4,250,995 teaches a case having a tapered rectangular insert, with the reeds held against the flat outer surfaces of the insert.

These cases provide varying degrees of distortion protection, however, reeds will still experience some degree of distortion as a natural result of the stresses to which they are subject. It is therefore often necessary to restore the desired qualities to a reed. This can be accomplished through sanding, carving and/or polishing and sealing of the reed.

SUMMARY OF THE INVENTION

It is an object of the present invention to provide a reed case which maintains reeds in a flat condition during storage.

It is another object of the invention to provide a device which protects reeds from damage during storage.

It is an object of the invention to provide a reed holding surface which allows for homogeneous drying of a reed while maintaining a flat reed surface.

It is a further object of the present invention to provide a device which acts as a working surface in the restoration of desired reed qualities.

It is yet another object of the present invention to provide a container with a controlled environment for reed storage.

It is a further object of the present invention to provide a device which isolates the stored reeds from dry climates and allows exposure of reeds during moist weather.

The reed holder taught in the exemplary embodiments described herein provides for the storage of a number of reeds in a secure manner, isolated from damage and adverse climate conditions, wherein each reed is held flat to reduce distortion during storage. The individual reeds are secured against interior flat surfaces of a central core member. The reeds are protected from contact or damage by the core member. An outer cover can be added to further protect the reeds and to provide a controlled environment for storage.

The holder taught in the present invention also provides a second set of flat surfaces, on the exterior of the core member opposite the surfaces utilized for reed securing, for use as working surfaces in the adjustment of reeds for restoration of desired qualities.

BRIEF DESCRIPTION OF THE DRAWINGS

For a better understanding of the nature of the present invention, reference is had to the following figures and detailed description, wherein like elements are accorded like reference numerals, and wherein:

FIG. 1A is a perspective assembly view of a first embodiment of the present invention.

FIG. 1B is a perspective view of an alternative core shape for the embodiment of FIG. 1A.

FIG. 1C is a perspective view of a second alternative core the embodiment of FIG. 1A.

FIG. 2 is a side cross sectional view of the core of the present invention taken along line 2—2 of FIG. 1.

FIG. 3 is an end cross sectional view of the core of the present invention taken along line 3—3 of FIG. 2.

FIG. 4 is a perspective assembly view of the core and insert of a second embodiment of the present invention.

FIGS. 5A and 5B are end views of the assembled core and insert of the present invention.

FIG. 6 is a side cross sectional view of the assembled core and insert of the present invention taken along line 6—6 of FIG. 5.

FIG. 7 is a perspective detail view illustrating the insert of the second embodiment.

DETAILED DESCRIPTION OF PREFERRED EXEMPLARY EMBODIMENTS

As illustrated in FIG. 1A, the first embodiment of the present invention includes a core 10 of hollow rectangular shape and square cross section, as illustrated in FIG. 3. Alternatively, the core can be of any regular shaped cross section, such as the triangular cross section of the core 11 illustrated in FIG. 1B. The reeds 18, by fitting to the flat interior surfaces of the core 10, 10' or 11, are protected from impact, while being held flat to resist warping. The core 10, 10' or 11 is preferably made from transparent material to allow for observation of indicia on both the upper and lower surfaces of the reeds 18.

A cover tube 12 and end caps 14 and 16 are provided for enclosure of the core 10 or 11 if desired. Cover 12 fits around the exterior of core 10 or 11. End caps 14 and 16 are closed at one end and fit snugly to the ends of cover 12 to provide a sealed enclosure within cover 12 for core 10. The reeds 18 held within the core can then be protected from atmospheric conditions as desired. A hygrostat chamber can be provided within the sealed enclosure to aid in maintaining the reeds at a desired humidity.

As illustrated in FIGS. 2 and 3, the reeds 18 are held against the flat interior walls of the core 10 by an elastic member 20 stretched between peg retainers 22 at the corners of core 10. Core 10 includes openings 24 at its corners for corners of the elastic member 20. The reeds can be slipped under the elastic member 20 from either open end of the core 10.

Alternatively, as illustrated in FIG. 1C, tabs 23 can be utilized instead of pegs 22. The tabs 23 are formed as part of the core 10, having one end attached to the core and a free end for receipt of the elastic band 20.

FIG. 1C also illustrates the provision of ventilation holes 25 in the surface against which the reeds rest. The ventilation holes allow for even drying of the reeds during storage by ventilating the surface of the reed which is held against the core 10'. The holes 25 are preferably positioned so that the thickest portion of the reed will rest adjacent the ventilated section of the core 10'. Because of the varying thickness of the reed along its length, the thin tapered tip will dry faster than the thicker body, potentially causing warpage. By providing ventilation holes 25 adjacent the thickened body, the rate of drying can be made more homogeneous.

As illustrated in FIG. 4 through 7, an insert 30 is utilized in the second embodiment to hold reeds 18 against the interior walls of core 32. In the second embodiment the core member 32 is not provided with corner openings, and is instead comprised of a continuous hollow member. The insert 30 fits closely to the interior dimensions of the core 32, as illustrated in FIGS. 5A and 5B.

One embodiment of insert 30, as illustrated in detail in FIG. 7, includes an X shaped frame 34 and elastic members 36. Insert 30 as illustrated in FIG. 5B is Y shaped. The insert is shaped according to the number of sides of core 32 to fit each corner of the core and to provide an elastic bias for each reed.

Insert 30 is placed within core 32 and fits securely into the corners of the hollow interior of the core 32. Reeds 18 can then be placed between the elastic members 36 and the interior faces of the core 32 where they are held securely by the biasing of elastic members 36.

As with the first embodiment, the reeds 18 are secured against the interior faces of the core 32 to maintain a flat shape and to protect the reeds from damage. As with the first embodiment, a cover and end caps (not illustrated) can be used to provide a controlled environment for reed storage.

The exterior surfaces of the cores 10, 11 or 32 can be provided with appropriate surfacing for proper reed working. Reed working includes the repair and refinement of reeds to provide for the optimal playing quality. Reed working includes sanding, carving, polishing and sealing of reeds. Sanding is most commonly accomplished with sand paper, polishing is achieved with smooth paper and sealing can be accomplished with wax paper. It is necessary to have an essentially flat surface for sanding, carving, polishing and sealing to insure the proper quality finished reed.

The exterior surfaces of the core provide flat surfaces for reed working. Paper is cut to the dimensions of the core surface and attached to the surface with adhesive. The musician then has the option of four surfaces which can be equipped with papers according to his particular preference and is able to store and work his reeds with a single case. If the paper and adhesive is removed, additional reeds can be stored by placing them against the outside surfaces of the core and securing by wrapping an elastic band around the reeds and the core. Because the cores 10 and 32 are square, and the core 11 is triangular, while the cover 12 is circular, the cover does not contact reeds arranged on the exterior surfaces of the core.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

I claim:

1. A reed case, comprising:

an elongated core means for supporting and enclosing a reed, having an open internal cavity with at least one flat interior surface within said cavity;

biasing means within said cavity for holding said reed against said interior surface; and an enclosure for surrounding said core and providing a controlled environment, including a cylindrical cover; and end caps.

2. The case of claim 1, wherein:

said biasing means is outwardly biasing.

3. The case of claim 1, wherein:

said core is longer than said reed.

4. The case of claim 1, wherein:

said biasing means includes an elastic member stretched across said interior surface, for placement of said reed between said interior surface and said elastic member.

5. The case of claim 1, wherein said enclosure further includes:

desiccant means for control of humidity within said controlled environment.

6. The case of claim 1, further including:

reed working material secured to at least one exterior surface of said core.

7. The case of claim 6, wherein:

said reed working material is secured to said exterior surface by a releasable adhesive.

8. The case of claim 1, wherein:

said core includes an opening adjacent each edge of said interior surface.

9. The reed case of claim 1, wherein said elongated core includes a plurality of flat interior surfaces attached at the edges to form at least three corners; and further comprising:

biasing means within said open interior for holding a reed against each of said interior surfaces, including an insert having a plurality of perpendicular planar members arranged in a configuration wherein one of said planar members extends from each corner of said core.

10. The case of claim 9, wherein said core has a triangular cross section, and said insert includes:

three planar arm members forming a Y shaped insert fitted to the dimensions of said cross section.

11. The case of claim 10, wherein:

said biasing member includes an elastic member for extending across the arms of said Y shaped member.

12. The case of claim 1, further including:

an insert for mounting of said biasing means.

13. The case of claim 12, wherein said core has a square cross section, and said insert includes:

two perpendicular planar arm members forming an X shaped insert fitted to the diagonal dimensions of said square cross section.

14. The case of claim 13, wherein:

said planar members have notches for recessed mounting of said biasing means.

15. The case of claim 13, wherein:

said biasing member includes an elastic member for extending across the arms of said X shaped member.

16. A reed case, comprising:

an elongated core means for supporting and enclosing a reed, having an open internal cavity with at least one flat interior surface within said cavity;

biasing means within said cavity for holding said reed against said interior surface; wherein:

said core includes a plurality of ventilation holes in said flat surface.

17. The case of claim 16, wherein:

said ventilation holes are positioned for placement adjacent the body of said reed.

18. A reed case, comprising:

an elongated core means for supporting and enclosing said reed, having an open internal cavity with at least one flat interior surface within said cavity;

biasing means within said cavity for holding a reed against said interior surface;

first and second secondary openings adjacent opposite edges of said interior surface;

wherein said biasing means includes:

an elastic member having loop portions extending through each of said secondary openings, and retaining members for engaging each of said loop portions.

19. The case of claim 18, wherein said retaining members includes:

peg means larger than each of said secondary openings, for insertion in said loop portions of said elastic member.

20. The case of claim 18, wherein said retaining members includes:

tab means extending adjacent each of said secondary openings, for receipt of said loop portions of said elastic member.

* * * * *